US008177582B2

(12) United States Patent
Amidon

(10) Patent No.: US 8,177,582 B2
(45) Date of Patent: May 15, 2012

(54) IMPEDANCE MANAGEMENT IN COAXIAL CABLE TERMINATIONS

(75) Inventor: Jeremy Amidon, Marcellus, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 232 days.

(21) Appl. No.: 12/753,719

(22) Filed: Apr. 2, 2010

(65) Prior Publication Data

US 2011/0244721 A1 Oct. 6, 2011

(51) Int. Cl.
*H01R 9/05* (2006.01)

(52) U.S. Cl. ..... 439/578; 29/857; 30/90.1; 174/68.1

(58) Field of Classification Search ..... 439/578; 174/68.1; 30/90.1; 29/857
See application file for complete search history.

(56) References Cited

U.S. PATENT DOCUMENTS

| | | | |
|---|---|---|---|
| 2,258,737 | A | 10/1941 | Browne |
| 2,785,384 | A | 3/1957 | Wickesser |
| 3,022,482 | A | 2/1962 | Waterfield et al. |
| 3,076,169 | A | 1/1963 | Blaisdell |
| 3,184,706 | A | 5/1965 | Atkins |
| 3,221,290 | A | 11/1965 | Stark et al. |
| 3,275,913 | A | 9/1966 | Blanchard et al. |
| 3,297,979 | A | 1/1967 | O'Keefe et al. |
| 3,321,732 | A | 5/1967 | Forney, Jr. |
| 3,355,698 | A | 11/1967 | Keller |
| 3,372,364 | A | 3/1968 | O'Keefe et al. |
| 3,406,373 | A | 10/1968 | Forney, Jr. |
| 3,498,647 | A | 3/1970 | Schroder |
| 3,539,976 | A | 11/1970 | Reynolds |
| 3,581,269 | A | 5/1971 | Frey |
| 3,629,792 | A | 12/1971 | Dorrell |
| 3,671,922 | A | 6/1972 | Zerlin et al. |
| 3,671,926 | A | 6/1972 | Nepovim |
| 3,678,446 | A | 7/1972 | Siebelist |
| 3,686,623 | A | 8/1972 | Nijman |
| 3,710,005 | A | 1/1973 | French |
| 3,744,011 | A | 7/1973 | Blanchenot |
| 3,757,279 | A | 9/1973 | Winston |

(Continued)

FOREIGN PATENT DOCUMENTS

DE 29800824 4/1998

(Continued)

OTHER PUBLICATIONS

Chawgo, S., et al., Coaxial Cable Compression Connectors, U.S. Appl. No. 13/093,937, filed Apr. 26, 2011.

(Continued)

*Primary Examiner* — Vanessa Girardi
(74) *Attorney, Agent, or Firm* — Schmeiser Olsen & Watts

(57) ABSTRACT

Managing impedance in coaxial cable termination. In one example embodiment, a method for terminating a coaxial cable is provided. The coaxial cable includes an inner conductor, an insulating layer surrounding the inner conductor, an outer conductor surrounding the insulating layer, and a jacket surrounding the outer conductor. The method includes various acts. First, a section of the insulating layer is cored out. Next, the diameter of the inner conductor that is positioned within the cored-out section is reduced. Then, at least a portion of an internal connector structure is inserted into the cored-out section so as to surround the section of reduced-diameter inner conductor. Finally, an external connector structure is affixed to the internal connector structure. A coaxial cable termination tool for use in the termination of a coaxial cable and a terminated coaxial cable are also disclosed.

20 Claims, 7 Drawing Sheets

U.S. PATENT DOCUMENTS

| | | | |
|---|---|---|---|
| 3,764,959 | A | 10/1973 | Toma et al. |
| 3,845,453 | A | 10/1974 | Hemmer |
| 3,879,102 | A | 4/1975 | Horak |
| 3,915,539 | A | 10/1975 | Collins |
| 3,936,132 | A | 2/1976 | Hutter |
| 3,963,321 | A | 6/1976 | Burger et al. |
| 3,985,418 | A | 10/1976 | Spinner |
| 4,035,054 | A | 7/1977 | Lattanzi |
| 4,046,451 | A | 9/1977 | Juds et al. |
| 4,047,291 | A | 9/1977 | Spinner |
| 4,053,200 | A | 10/1977 | Pugner |
| 4,059,330 | A | 11/1977 | Shirey |
| 4,126,372 | A | 11/1978 | Hashimoto et al. |
| 4,156,554 | A | 5/1979 | Aujla |
| 4,168,921 | A | 9/1979 | Blanchard |
| 4,173,385 | A | 11/1979 | Fenn et al. |
| 4,227,765 | A | 10/1980 | Neumann et al. |
| 4,280,749 | A | 7/1981 | Hemmer |
| 4,305,638 | A | 12/1981 | Hutter |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward |
| 4,408,821 | A | 10/1983 | Forney, Jr. |
| 4,408,822 | A | 10/1983 | Nikitas |
| 4,421,377 | A | 12/1983 | Spinner |
| 4,444,453 | A | 4/1984 | Kirby et al. |
| 4,456,324 | A | 6/1984 | Staeger |
| 4,484,792 | A | 11/1984 | Tengler et al. |
| 4,491,685 | A | 1/1985 | Drew et al. |
| 4,533,191 | A | 8/1985 | Blackwood |
| 4,545,637 | A | 10/1985 | Bosshard et al. |
| 4,557,546 | A | 12/1985 | Dreyer |
| 4,575,274 | A | 3/1986 | Hayward |
| 4,583,811 | A | 4/1986 | McMills |
| 4,596,435 | A | 6/1986 | Bickford |
| 4,600,263 | A | 7/1986 | DeChamp et al. |
| 4,614,390 | A | 9/1986 | Baker |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,684,201 | A | 8/1987 | Hutter |
| 4,691,976 | A | 9/1987 | Cowen |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,789,355 | A | 12/1988 | Lee |
| 4,804,338 | A | 2/1989 | Dibble et al. |
| 4,806,116 | A | 2/1989 | Ackerman |
| 4,813,886 | A | 3/1989 | Roos et al. |
| 4,824,400 | A | 4/1989 | Spinner |
| 4,824,401 | A | 4/1989 | Spinner |
| 4,834,675 | A | 5/1989 | Samchisen |
| 4,854,893 | A | 8/1989 | Morris |
| 4,857,014 | A | 8/1989 | Alf et al. |
| 4,869,679 | A | 9/1989 | Szegda |
| 4,892,275 | A | 1/1990 | Szegda |
| 4,902,246 | A | 2/1990 | Samchisen |
| 4,906,207 | A | 3/1990 | Banning et al. |
| 4,917,631 | A | 4/1990 | Souders et al. |
| 4,923,412 | A | 5/1990 | Morris |
| 4,925,403 | A | 5/1990 | Zorzy |
| 4,929,188 | A | 5/1990 | Lionetto et al. |
| 4,973,265 | A | 11/1990 | Heeren |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,011,432 | A | 4/1991 | Sucht et al. |
| 5,021,010 | A | 6/1991 | Wright |
| 5,024,606 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver, Jr. et al. |
| 5,073,129 | A | 12/1991 | Szegda |
| 5,083,943 | A | 1/1992 | Tarrant |
| 5,127,853 | A | 7/1992 | McMills et al. |
| 5,131,862 | A | 7/1992 | Gershfeld |
| 5,137,471 | A | 8/1992 | Verespej et al. |
| 5,141,451 | A | 8/1992 | Down |
| 5,154,636 | A | 10/1992 | Vaccaro et al. |
| 5,166,477 | A | 11/1992 | Perin, Jr. et al. |
| 5,181,161 | A | 1/1993 | Hirose et al. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Leibfried, Jr. |
| 5,283,853 | A | 2/1994 | Szegda |
| 5,284,449 | A | 2/1994 | Vaccaro |
| 5,295,864 | A | 3/1994 | Birch et al. |
| 5,316,494 | A | 5/1994 | Flanagan et al. |
| 5,322,454 | A | 6/1994 | Thommen |
| 5,338,225 | A | 8/1994 | Jacobsen et al. |
| 5,340,332 | A | 8/1994 | Nakajima et al. |
| 5,342,218 | A | 8/1994 | McMills et al. |
| 5,352,134 | A | 10/1994 | Jacobsen et al. |
| 5,354,217 | A | 10/1994 | Gabel et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,435,745 | A | 7/1995 | Booth |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,494,454 | A | 2/1996 | Johnsen |
| 5,501,616 | A | 3/1996 | Holliday |
| 5,518,420 | A | 5/1996 | Pitschi |
| 5,525,076 | A | 6/1996 | Down |
| 5,542,861 | A | 8/1996 | Anhalt et al. |
| 5,548,088 | A | 8/1996 | Gray et al. |
| 5,561,900 | A | 10/1996 | Hosler, Sr. |
| 5,571,028 | A | 11/1996 | Szegda |
| 5,586,910 | A | 12/1996 | Del Negro et al. |
| 5,598,132 | A | 1/1997 | Stabile |
| 5,607,325 | A | 3/1997 | Toma |
| 5,619,015 | A | 4/1997 | Kirma |
| 5,651,698 | A | 7/1997 | Locati et al. |
| 5,651,699 | A | 7/1997 | Holliday |
| 5,662,489 | A | 9/1997 | Stirling |
| 5,667,405 | A | 9/1997 | Holliday |
| 5,785,554 | A | 7/1998 | Ohshiro |
| 5,795,188 | A | 8/1998 | Harwath |
| 5,863,220 | A | 1/1999 | Holliday |
| 5,938,474 | A | 8/1999 | Nelson |
| 5,957,724 | A | 9/1999 | Lester |
| 5,975,951 | A | 11/1999 | Burris et al. |
| 5,984,723 | A | 11/1999 | Wild |
| 5,993,254 | A | 11/1999 | Pitschi et al. |
| 5,997,350 | A | 12/1999 | Burris et al. |
| 6,019,636 | A | 2/2000 | Langham |
| 6,027,373 | A | 2/2000 | Gray et al. |
| 6,032,358 | A | 3/2000 | Wild |
| 6,034,325 | A | 3/2000 | Nattel et al. |
| 6,036,237 | A | 3/2000 | Sweeney |
| RE36,700 | E | 5/2000 | McCarthy |
| 6,080,015 | A | 6/2000 | Andreescu |
| 6,089,912 | A | 7/2000 | Tallis et al. |
| 6,089,913 | A | 7/2000 | Holliday |
| 6,146,197 | A | 11/2000 | Holliday et al. |
| 6,159,046 | A | 12/2000 | Wong |
| 6,168,455 | B1 | 1/2001 | Hussaini |
| 6,217,380 | B1 | 4/2001 | Nelson et al. |
| 6,293,004 | B1 | 9/2001 | Holliday |
| 6,396,367 | B1 | 5/2002 | Rosenberger |

| | | | |
|---|---|---|---|
| 6,409,536 | B1 | 6/2002 | Kanda et al. |
| 6,471,545 | B1 | 10/2002 | Hosier, Sr. |
| 6,536,103 | B1 | 3/2003 | Holland et al. |
| 6,551,136 | B2 | 4/2003 | Johnsen et al. |
| 6,607,398 | B2 | 8/2003 | Henningsen |
| 6,634,906 | B1 | 10/2003 | Yeh |
| 6,648,683 | B2 | 11/2003 | Youtsey |
| 6,667,440 | B2 | 12/2003 | Nelson et al. |
| 6,733,336 | B1 | 5/2004 | Montena et al. |
| 6,780,052 | B2 | 8/2004 | Montena et al. |
| 6,808,415 | B1 | 10/2004 | Montena |
| 6,808,417 | B2 | 10/2004 | Yoshida |
| 6,840,803 | B2 | 1/2005 | Wlos et al. |
| 6,887,103 | B2 | 5/2005 | Montena et al. |
| 6,994,588 | B2 | 2/2006 | Montena |
| 7,011,546 | B2 | 3/2006 | Vaccaro |
| 7,029,304 | B2 | 4/2006 | Montena |
| 7,044,785 | B2 | 5/2006 | Harwath et al. |
| 7,104,839 | B2 | 9/2006 | Henningsen |
| 7,108,547 | B2 | 9/2006 | Kisling et al. |
| 7,127,806 | B2 | 10/2006 | Nelson et al. |
| 7,128,603 | B2 | 10/2006 | Burris et al. |
| 7,140,914 | B2 | 11/2006 | Kojima |
| 7,207,838 | B2 | 4/2007 | Andreescu |
| 7,217,154 | B2 | 5/2007 | Harwath |
| 7,261,581 | B2 | 8/2007 | Henningsen |
| 7,275,957 | B1 | 10/2007 | Wlos |
| 7,311,554 | B1 | 12/2007 | Jackson et al. |
| 7,335,059 | B2 | 2/2008 | Vaccaro |
| 7,357,671 | B2 | 4/2008 | Wild et al. |
| 7,381,089 | B2 | 6/2008 | Hosler, Sr. |
| 7,384,307 | B1 | 6/2008 | Wang |
| 7,435,135 | B2 | 10/2008 | Wlos |
| 7,488,209 | B2 | 2/2009 | Vaccaro |
| 7,527,512 | B2 | 5/2009 | Montena |
| 7,588,460 | B2 | 9/2009 | Malloy et al. |
| 7,637,774 | B1 | 12/2009 | Vaccaro |
| 7,934,954 | B1 | 5/2011 | Chawgo et al. |
| 2001/0051448 | A1 | 12/2001 | Gonzales |
| 2005/0159043 | A1 | 7/2005 | Harwath et al. |
| 2005/0159044 | A1 | 7/2005 | Harwath et al. |
| 2007/0123101 | A1 | 5/2007 | Palinkas |
| 2007/0190854 | A1 | 8/2007 | Harwath |
| 2009/0019704 | A1 | 1/2009 | Ehret et al. |
| 2009/0233482 | A1 | 9/2009 | Chawgo et al. |
| 2011/0239451 | A1 | 10/2011 | Montena et al. |
| 2011/0239455 | A1 | 10/2011 | Montena et al. |
| 2011/0244722 | A1 | 10/2011 | Chawgo et al. |

FOREIGN PATENT DOCUMENTS

| | | | |
|---|---|---|---|
| EP | 0010567 | | 5/1980 |
| EP | 0918370 | | 5/1999 |
| EP | 2063501 | A1 | 5/2009 |
| JP | 2002373743 | A | 12/2002 |

OTHER PUBLICATIONS

PCT/US2011/031004 International Search Report and Written Opinion. Date of Mailing Nov. 8, 2011. 9 pp.

Montena, N. et al., Coaxial Cable Preparation Tools, U.S. Appl. No. 12/753,729, filed Apr. 2, 2010.

Chawgo, S. and Montena, N., Coaxial Cable Compression Connectors, U.S. Appl. No. 12/753,735, filed Apr. 2, 2010.

Montena, N. and Chawgo, S., Passive Intermodulation and Impedance Management in Coaxial Cable Terminations, U.S. Appl. No. 12/753,742, filed Apr. 2, 2010.

IMPEDANCE MANAGEMENT IN COAXIAL CABLE TERMINATIONS

BACKGROUND

Coaxial cable is used to transmit radio frequency (RF) signals in various applications, such as connecting radio transmitters and receivers with their antennas, computer network connections, and distributing cable television signals. Coaxial cable typically includes an inner conductor, an insulating layer surrounding the inner conductor, an outer conductor surrounding the insulating layer, and a protective jacket surrounding the outer conductor.

Each type of coaxial cable has a characteristic impedance which is the opposition to signal flow in the coaxial cable. The impedance of a coaxial cable depends on its dimensions and the materials used in its manufacture. For example, a coaxial cable can be tuned to a specific impedance by controlling the diameters of the inner and outer conductors and the dielectric constant of the insulating layer. All of the components of a coaxial system should have the same impedance in order to reduce internal reflections at connections between components. Such reflections increase signal loss and can result in the reflected signal reaching a receiver with a slight delay from the original.

Two sections of a coaxial cable in which it can be difficult to maintain a consistent impedance are the terminal sections on either end of the cable to which connectors are attached. For example, the attachment of some connectors requires the removal of a section of the insulating layer at the terminal end of the coaxial cable in order to insert a support structure of the connector between the inner conductor and the outer conductor. The support structure of the connector prevents the collapse of the outer conductor when the connector applies pressure to the outside of the outer conductor. Unfortunately, however, the dielectric constant of the support structure often differs from the dielectric constant of the insulating layer that the support structure replaces, which changes the impedance of the terminal ends of the coaxial cable. This change in the impedance at the terminal ends of the coaxial cable causes increased internal reflections, which result in increased signal loss.

SUMMARY OF SOME EXAMPLE EMBODIMENTS

In general, example embodiments of the present invention relate to managing impedance in coaxial cable terminations. The example embodiments disclosed herein include a reduction in the diameter of the inner conductor in a terminal section of the coaxial cable during cable termination. The reduced-diameter inner conductor compensates for the replacement of the insulating layer with a connector support structure in the terminal section. This compensation enables the impedance to remain consistent along the entire length of the coaxial cable, thus avoiding internal reflections and resulting signal loss associated with inconsistence impedance.

In one example embodiment, a method for terminating a coaxial cable is provided. The coaxial cable includes an inner conductor, an insulating layer surrounding the inner conductor, an outer conductor surrounding the insulating layer, and a jacket surrounding the outer conductor. The method includes various acts. First, a section of the insulating layer is cored out. Next, the diameter of the inner conductor that is positioned within the cored-out section is reduced. Then, at least a portion of an internal connector structure is inserted into the cored-out section so as to surround the reduced-diameter inner conductor. Finally, an external connector structure is affixed to the internal connector structure.

In another example embodiment, a coaxial cable termination tool is configured for use in the termination of a coaxial cable. The coaxial cable includes an inner conductor, an insulating layer surrounding the inner conductor, an outer conductor surrounding the insulating layer, and a jacket surrounding the outer conductor. The coaxial cable termination tool includes a body having a means for coring out a section of the insulating layer and a means for reducing the diameter of the inner conductor that is positioned within the cored-out section.

In yet another example embodiment, a terminated coaxial cable includes an inner conductor configured to propagate a signal, an insulating layer surrounding the inner conductor, an outer conductor surrounding the insulating layer, a jacket surrounding the outer conductor, and a terminal section of the coaxial cable. The terminal section includes a cored-out section of the coaxial cable in which the insulating layer has been removed and the diameter of the inner conductor has been reduced, at least a portion of a connector mandrel positioned within the cored-out section and surrounding the reduced-diameter inner conductor, and an external connector structure connected to the mandrel.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to managing impedance in coaxial cable terminations. In the following detailed description of some example embodiments, reference will now be made in detail to example embodiments of the present invention which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. Example Coaxial Cable and Example Coaxial Cable Connectors

Figure 1A:
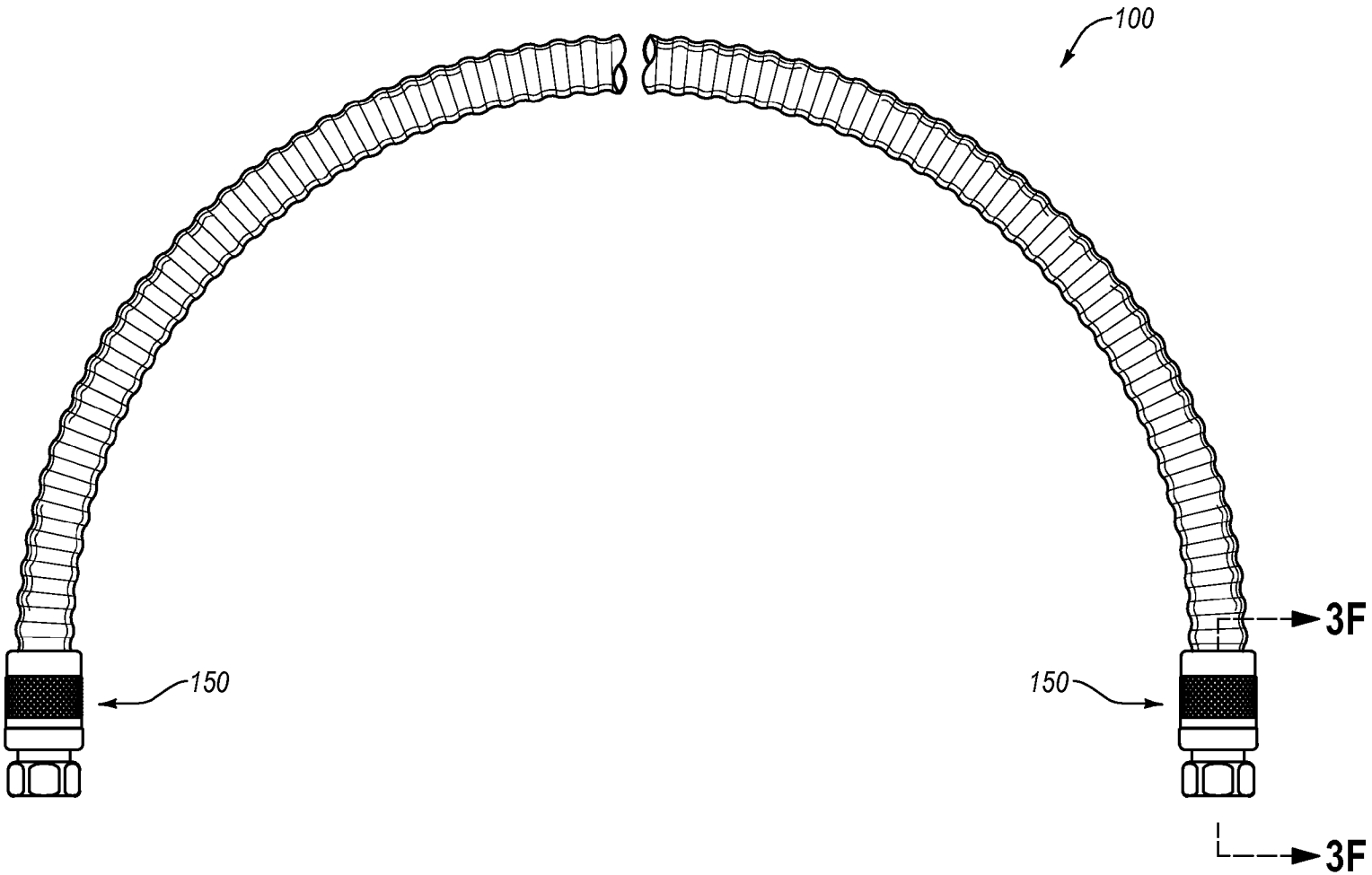
FIG. 1A is a perspective view of an example coaxial cable terminated with two example connectors.

With reference now to FIG. 1A, a first example coaxial cable 100 is disclosed. The example coaxial cable 100 has 50 Ohms of impedance and is a ⅞" series corrugated coaxial cable. It is understood, however, that these cable characteristics are example characteristics only, and that the example termination methods and tools disclosed herein can also benefit coaxial cables with other impedance, dimension, and shape characteristics.

Also disclosed in FIG. 1A, the example coaxial cable 100 is terminated on either end with identical example connectors 150. Although the connectors 150 are disclosed in FIG. 1A as Deutsches Institut für Normung (DIN) male compression-type connectors, it is understood that cable 100 can also be terminated with other types of male and/or female connectors (not shown).

Figure 1B:
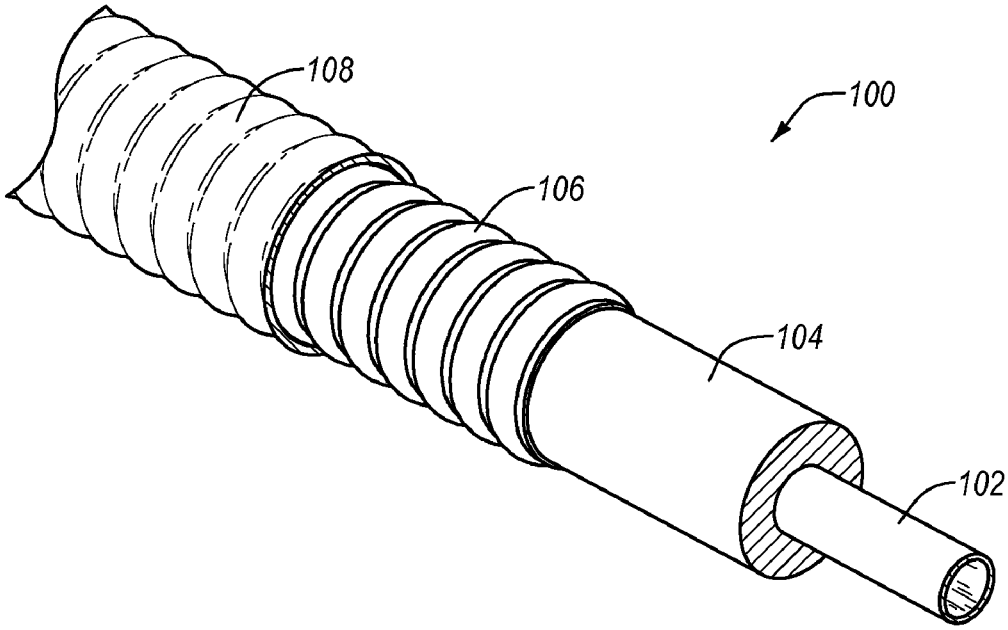
FIG. 1B is a perspective view of a portion of the coaxial cable of FIG. 1A, the perspective view having portions of each layer of the coaxial cable cut away.

With reference now to FIG. 1B, the coaxial cable 100 generally includes an inner conductor 102 surrounded by an insulating layer 104, an outer conductor 106 surrounding the insulating layer 104, and a jacket 108 surrounding the outer conductor 106. As used herein, the phrase "surrounded by" refers to an inner layer generally being encased by an outer layer. However, it is understood that an inner layer may be "surrounded by" an outer layer without the inner layer being immediately adjacent to the outer layer. The term "surrounded by" thus allows for the possibility of intervening layers. Each of these components of the example coaxial cable 100 will now be discussed in turn.

The inner conductor 102 is positioned at the core of the example coaxial cable 100 and may be configured to carry a range of electrical current (amperes) and/or RF/electronic digital signals. The inner conductor 102 can be formed from copper, copper-clad aluminum (CCA), copper-clad steel (CCS), or silver-coated copper-clad steel (SCCCS), although other conductive materials are also possible. For example, the inner conductor 102 can be formed from any type of conductive metal or alloy. In addition, although the inner conductor 102 of FIG. 1B is hollow, it could instead have other configurations such as solid, stranded, corrugated, plated, or clad, for example.

The insulating layer 104 surrounds the inner conductor 102, and generally serves to support the inner conductor 102 and insulate the inner conductor 102 from the outer conductor 106. Although not shown in the figures, a bonding agent, such as a polymer, may be employed to bond the insulating layer 104 to the inner conductor 102. As disclosed in FIG. 1B, the insulating layer 104 is formed from a foamed material such as, but not limited to, a foamed polymer or fluoropolymer. For example, the insulating layer 104 can be formed from foamed polyethylene (PE).

The outer conductor 106 surrounds the insulating layer 104, and generally serves to minimize the ingress and egress of high frequency electromagnetic radiation to/from the inner conductor 102. In some applications, high frequency electromagnetic radiation is radiation with a frequency that is greater than or equal to about 50 MHz. The outer conductor 106 can be formed from solid copper, copper-clad aluminum (CCA), copper-clad steel (CCS), or silver-coated copper-clad steel (SCCCS), although other conductive materials are also possible. In addition, the outer conductor 106 has a corrugated wall, although it could instead have a generally smooth wall.

The jacket 108 surrounds the outer conductor 106, and generally serves to protect the internal components of the coaxial cable 100 from external contaminants, such as dust, moisture, and oils, for example. In a typical embodiment, the jacket 108 also functions to limit the bending radius of the cable to prevent kinking, and functions to protect the cable (and its internal components) from being crushed or otherwise misshapen from an external force. The jacket 108 can be formed from a variety of materials including, but not limited to, polyethylene (PE), high-density polyethylene (HDPE), low-density polyethylene (LDPE), linear low-density polyethylene (LLDPE), rubberized polyvinyl chloride (PVC), or some combination thereof. The actual material used in the formation of the jacket 108 might be indicated by the particular application/environment contemplated.

Figure 1C:
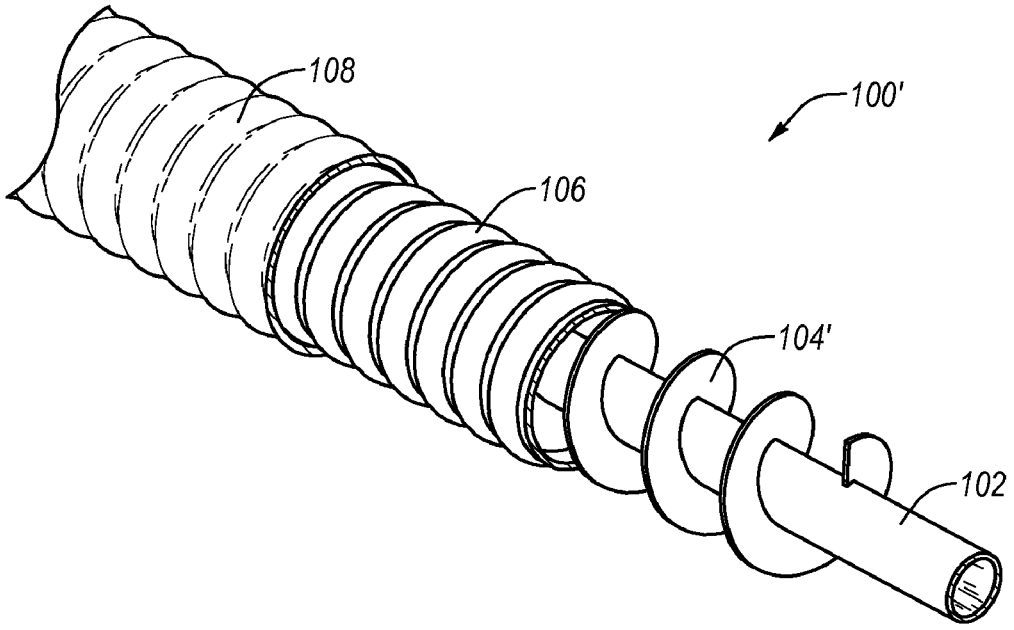
FIG. 1C is a perspective view of a portion of an alternative coaxial cable, the perspective view having portions of each layer of the alternative coaxial cable cut away.

It is understood that the insulating layer 104 can be formed from other types of insulating materials or structures having a dielectric constant that is sufficient to insulate the inner conductor 102 from the outer conductor 106. For example, as disclosed in FIG. 1C, an alternative coaxial cable 100' includes an alternative insulating layer 104' composed of a spiral-shaped spacer that enables the inner conductor 102 to be generally separated from the outer conductor 106 by air. The spiral-shaped spacer of the alternative insulating layer 104' may be formed from polyethylene or polypropylene, for example. The combined dielectric constant of the spiral-shaped spacer and the air in the alternative insulating layer 104' would be sufficient to insulate the inner conductor 102 from the outer conductor 106 in the alternative coaxial cable 100'. Further, the example termination methods and tools disclosed herein can similarly benefit the alternative coaxial cable 100'.

II. Example Method for Terminating a Coaxial Cable

With reference to FIGS. 2 and 3A-3F, an example method 200 for terminating the coaxial cable 100 is disclosed. The example method 200 enables the coaxial cable 100 to be terminated with a connector while maintaining a consistent impedance along the entire length of the coaxial cable 100, thus avoiding internal reflections and resulting signal loss associated with inconsistent impedance.

Figure 2:
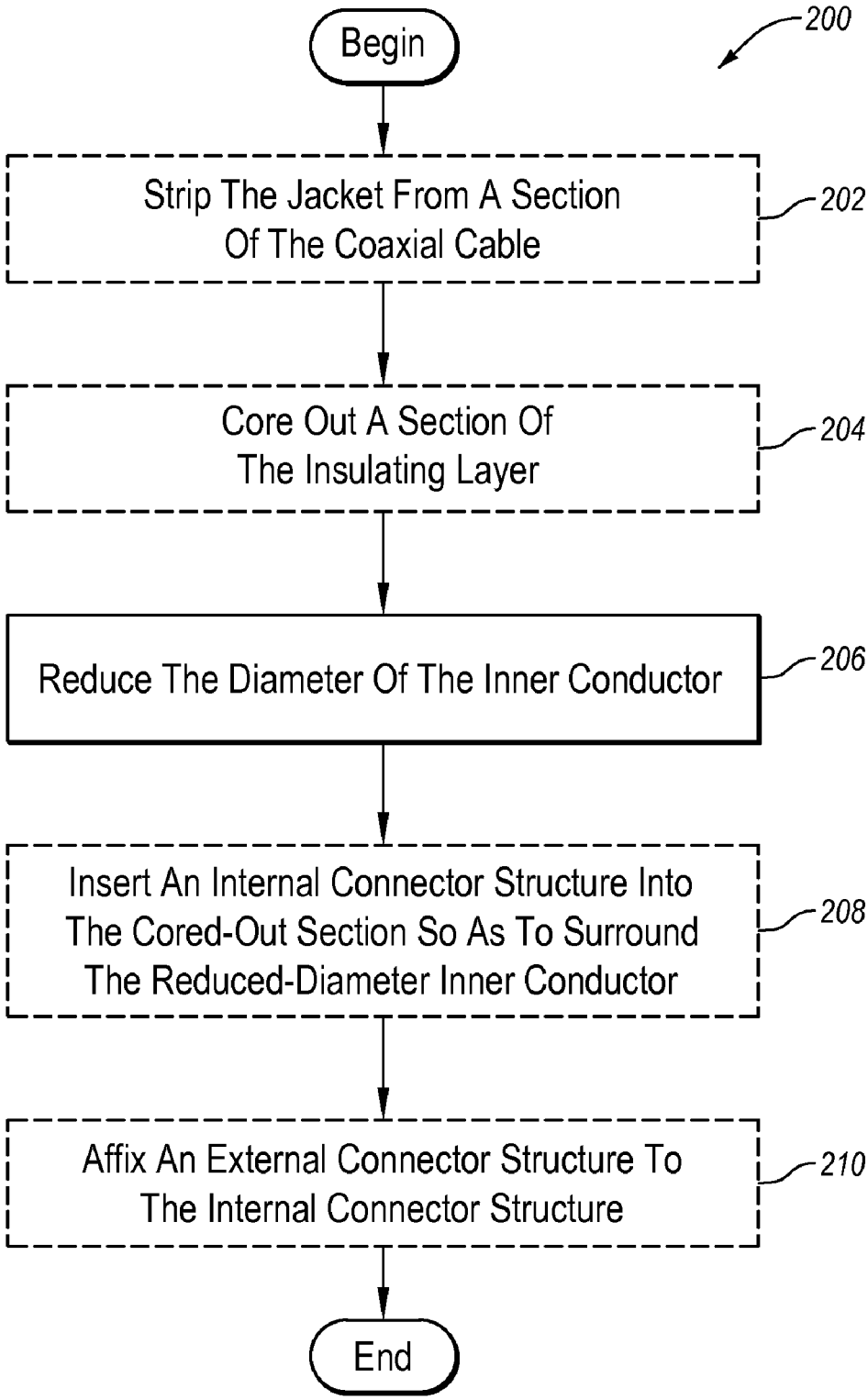
FIG. 2 is a flowchart of an example method for terminating the coaxial cable of FIGS. 1A and 1B with one of the example connectors of FIG. 1A.
Figure 3A:
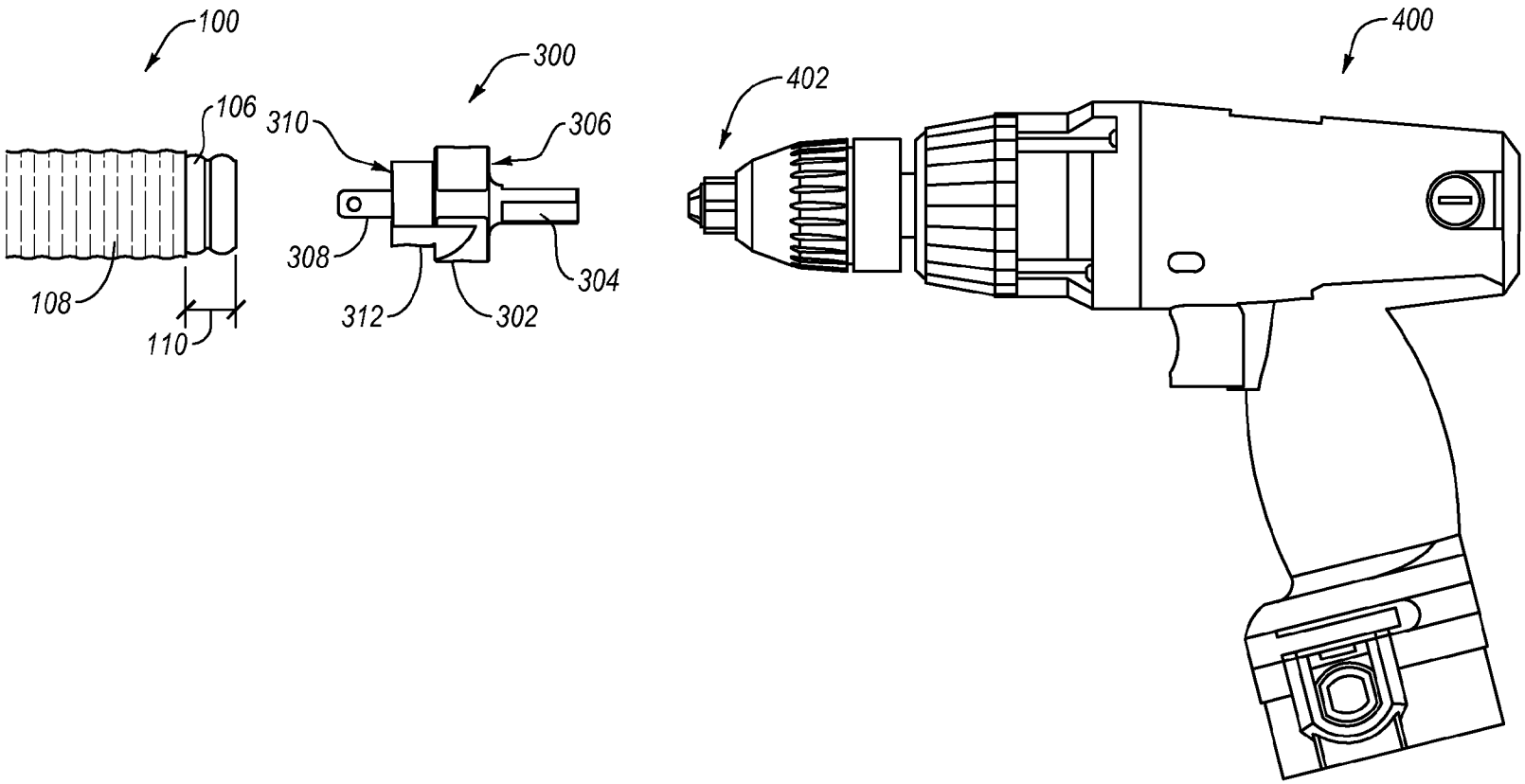
FIG. 3A is a side view of a terminal end of the example coaxial cable of FIGS. 1A and 1B, an example coaxial cable termination tool, and an example drill.

With reference to FIGS. 2 and 3A, the method 200 begins with an act 202 in which the jacket 108 is stripped from a section 110 of the coaxial cable 100. This stripping of the jacket 108 can be accomplished using a stripping tool (not shown) that is configured to automatically strip the section 110 of the jacket 108 from the coaxial cable 100. For example, in the example embodiment disclosed in FIG. 3A, a stripping tool was used to strip 0.51 inches of the jacket 108 from the stripped section 110 of the coaxial cable 100. The length of 0.51 inches corresponds to the length of exposed outer conductor 106 required by the connector 150 (see FIG. 1A), although it is understood that other lengths are contemplated to correspond to the requirements of other connectors. Alternatively, the step 202 may be omitted altogether where the jacket 108 has been pre-stripped from the section 110 of the coaxial cable 100 prior to the performance of the example method 200.

With reference to FIGS. 2 and 3A-3D, the method 200 continues with an act 204 in which a section 112 of the insulating layer 104 is cored out, and with an act 206 in which the diameter of the inner conductor 102 that is positioned within the cored-out section 112 is reduced. As disclosed in FIG. 3A-3C, the coring out and diameter reducing of the acts 204 and 206 can be accomplished simultaneously using an example coaxial cable termination tool 300 attached to a drill 400. Although the example tool 300 can be used to perform the acts 204 and 206 simultaneously, it is understood that the acts 204 and 206 can instead be performed sequentially, or in reverse order, using a single tool or separate tools.

As disclosed in FIG. 3A, the example tool 300 includes a body 302, a drive shank 304 extending from a back end 306 of the body 302, and a guide pin 308 extending outward from a front end 310 of the body 302. As disclosed in FIGS. 3B and 3C, the drive shank 304 is configured to be received in a drill chuck 402 of the drill 400. The guide pin 308 is configured to be inserted into the hollow portion of the inner conductor 102.

Although not disclosed in the drawings, it is understood that the drive shank 304 can be replaced with one or more other drive elements that are configured to be rotated, by hand or by drill for example, in order to rotate the body 302. For example, the body 302 may define a drive element such as a hex socket into which a manual hex wrench, or a hex drive shank attached to a drill, can be inserted. In another example, a drive element may be attached to the body 302, such as a hex head that can be received in a hex socket, and be hand driven or drill driven in order to rotate the body 302. Accordingly, the example tool 300 is not limited to being driven using the drive shank 304.

Figure 3B:
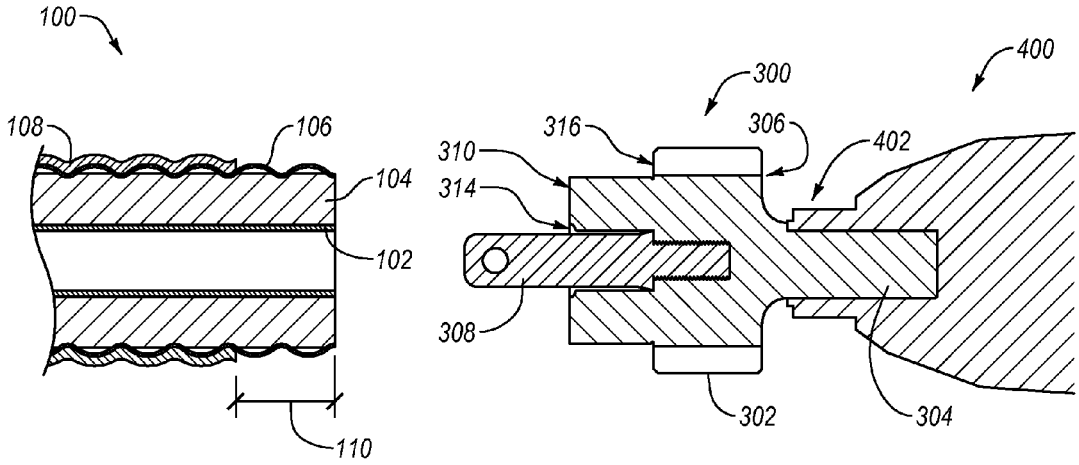
FIG. 3B is a cross-sectional view of the terminal end of the example coaxial cable of FIG. 3A and the example coaxial cable termination tool of FIG. 3A attached to the example drill of FIG. 3A.

Also disclosed in FIGS. 3A and 3B, the body 302 of the example tool 300 includes a rotary cutting blade 312 configured to automatically cut out a section of the insulating layer 104. The rotary cutting blade 312 is therefore one example structural implementation of a means for coring out a section of the insulating layer 104.

It is noted that a variety of means may be employed to perform the functions disclosed herein concerning the rotary cutting blade 312 coring out a section of the insulating layer 104. Thus, the rotary cutting blade 312 comprises but one example structural implementation of a means for coring out a section of the insulating layer 104.

Accordingly, it should be understood that this structural implementation is disclosed herein solely by way of example and should not be construed as limiting the scope of the present invention in any way. Rather, any other structure or combination of structures effective in implementing the functionality disclosed herein may likewise be employed. For example, in some example embodiments of the example tool 300, the rotary cutting blade 312 may be replaced or augmented with one or more other cutting or shaving blades, melting elements, laser elements, or crushing elements. In yet other example embodiments, the coring functionality may be accomplished by some combination of the above example embodiments.

Figure 3C:
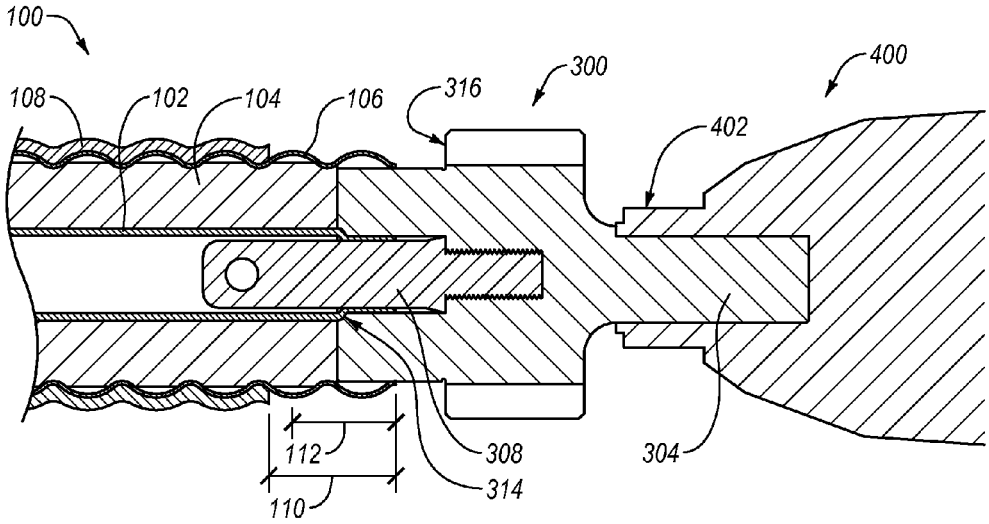
FIG. 3C is a cross-sectional view of the terminal end of the example coaxial cable of FIG. 3A and the example coaxial cable termination tool and drill of FIG. 3B, with the example coaxial cable termination tool partially drilled into the terminal end of the coaxial cable.

As disclosed in FIGS. 3B and 3C, the body 302 of the example tool 200 also includes a rotary swaging die 314 configured to automatically rotationally swage a section of the center conductor 102. The rotary swaging die 314 is therefore one example structural implementation of a means for reducing the diameter of the inner conductor 102.

It is noted that a variety of means may be employed to perform the functions disclosed herein concerning the rotary swaging die 314 reducing the diameter of the inner conductor 102. Thus, the rotary swaging die 314 comprises but one example structural implementation of a means for reducing the diameter of the inner conductor 102.

Accordingly, it should be understood that this structural implementation is disclosed herein solely by way of example and should not be construed as limiting the scope of the present invention in any way. Rather, any other structure or combination of structures effective in implementing the functionality disclosed herein may likewise be employed. By way of example, in some example embodiments of the example tool 300, the rotary swaging die 314 may be replaced or augmented with one or more other swaging or reshaping structures, blades, files, melting elements, or laser elements. In yet other example embodiments, the diameter reducing functionality may be accomplished by some combination of the above example embodiments.

It is understood that some of the example embodiments, such as the rotary swaging die 314, reduce the diameter of the inner conductor 102 without removing any of the material from which the inner conductor 102 is formed, although swaging may elongate the inner conductor 102. In contrast, other example embodiments, such as blades and files (not shown), reduce the diameter of the inner conductor 102 by removing a portion of the material from which the inner conductor 102 is formed. Generally, however, this removal of a portion of the material from which an inner conductor is formed may be limited to use with inner conductors of sufficient thickness that the removal will not interfere with the signal-carrying portion of the inner conductor, such as with solid copper inner conductors.

As disclosed in FIG. 3B, after the drive shank 304 of the example tool 300 is secured within the drill chuck 402 of the drill 400, the guide pin 308 can be inserted into the hollow portion of the inner conductor 102. Then, as disclosed in FIG. 3C, the drill 400 can be operated in order to spin the tool 300. As the tool 300 spins, the rotary cutting blade 312 functions to cut away the section 112 of the insulating layer 104. Simultaneously, the rotary swaging die 314 functions to rotationally swage the inner conductor 102 within the section 112. The example tool 300 can continue drilling into the coaxial cable 100 until a front stop 316 of the body 302 of the tool 300 makes contact with the terminal edge of the outer conductor 106, at which point the tool 300 can proceed no further. As disclosed in FIG. 3C, the rotary swaging die 314 is configured to reduce the diameter of the hollow portion of the inner conductor 102 to be about equal to the diameter of the pin 308. Thus, the pin 308 also acts as a die to allow the hollow portion of the inner conductor 102 to have a circular internal cross-section after the outside diameter of the inner conductor 102 is reduced. In addition, the pin 308 and the rotary swaging die 314 function to burnish and clean surfaces of the inner conductor 102 with which they come in contact. This burnishing and cleaning is accomplished with minimal degradation of the inner conductor 102.

Figure 3D:
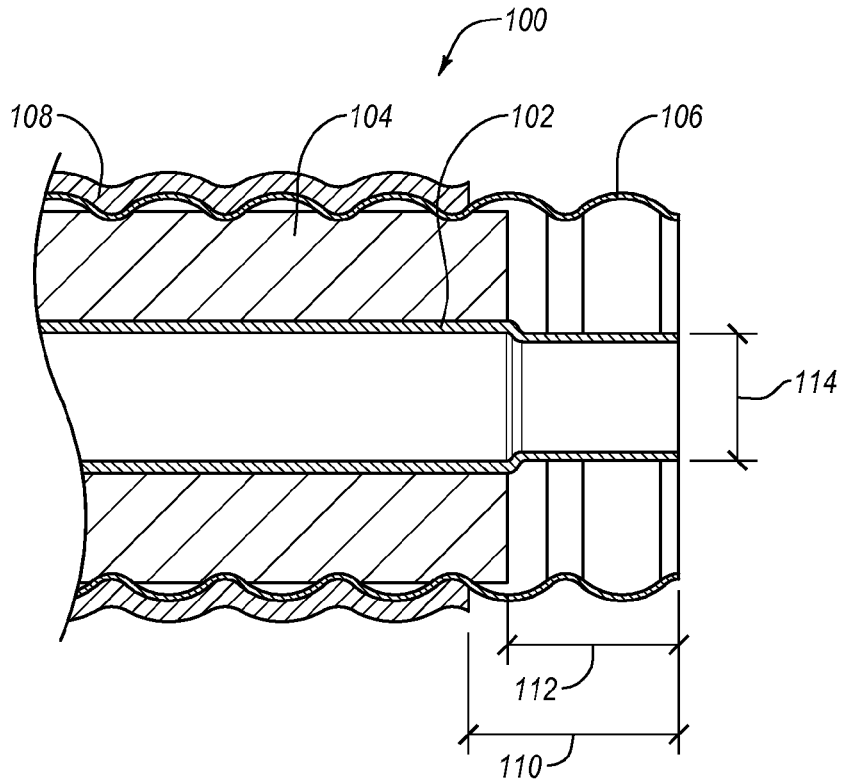
FIG. 3D is a cross-sectional view of the terminal end of the example coaxial cable of FIG. 3A after the example coaxial cable termination tool of FIG. 3A has been fully drilled into, and removed from, the terminal end of the coaxial cable.

The previously discussed drilling operation of the tool 300 results in the coring out of the section 112 of the insulating layer 104, and the reducing of the diameter of the inner conductor 102 that is positioned within the cored-out section 112, as disclosed in FIG. 3D. As disclosed in FIG. 3C, the length of the cored-out section is 0.39 inches, which corresponds to the length of cored-out insulating layer 104 required by the connector 150 (see FIG. 1A), although it is understood that other lengths are contemplated to correspond to the requirements of other connectors. Further, the reduced diameter 114 of the inner conductor 102 corresponds to the diameter required by the connector 150 (see FIG. 1A). It is understood that other diameters are contemplated to correspond to the requirements of other connectors.

Figure 3E:
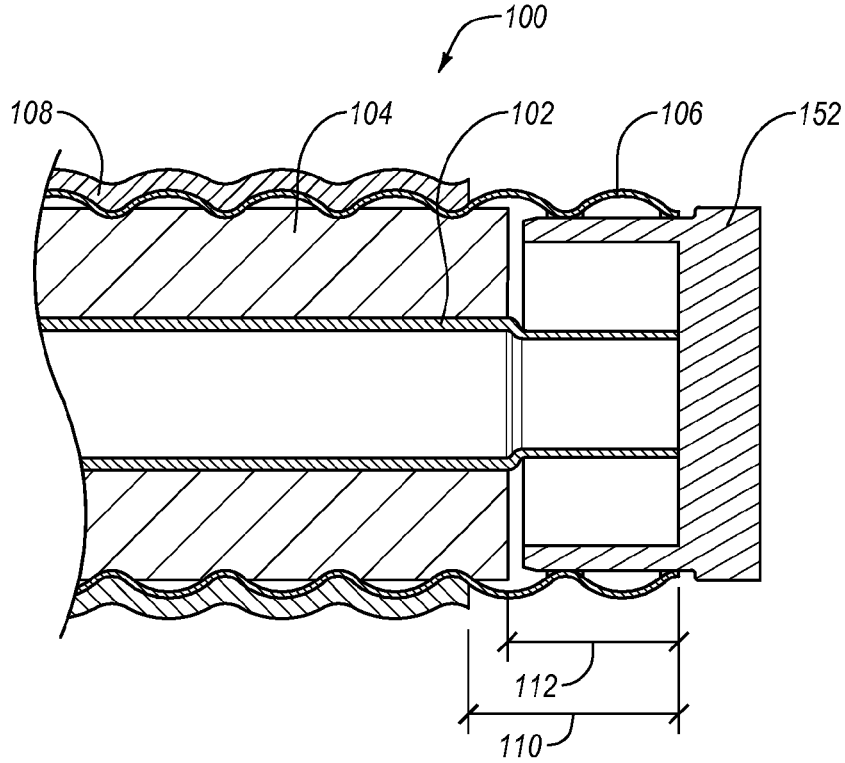
FIG. 3E is a cross-sectional view of the terminal end of the example coaxial cable of FIG. 3D with an example internal connector structure inserted into the terminal end of the coaxial cable.

With reference to FIGS. 2 and 3E, the method 200 continues with an act 208 in which at least a portion of an internal connector structure 152 is inserted into the cored-out section 112 so as to surround the reduced-diameter inner conductor 102. As disclosed in FIGS. 3E and 3F, the connector 150 generally includes the internal connector structure 152 and an external connector structure 154. It is noted that the length of the cored-out section 112 of the coaxial cable 100 is about equal to the length of the portion of the internal connector structure 152 that is inserted into the cored-out section 112.

Figure 3F:
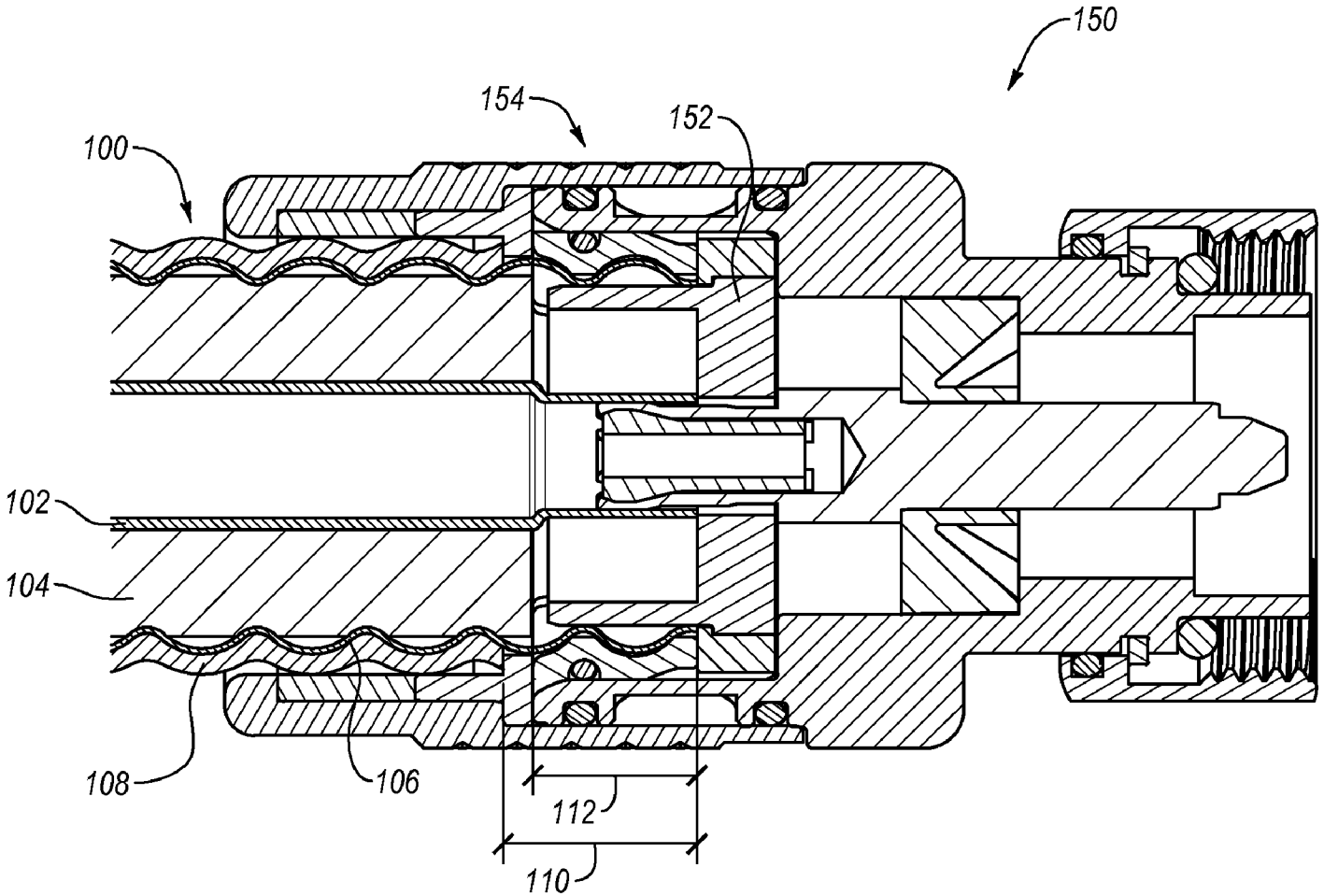
FIG. 3F is a cross-sectional view of a terminal end of the example coaxial cable of FIG. 1A having one of the connectors of FIG. 1A attached thereto.

As disclosed in FIGS. 3E and 3F, the internal connector structure 152 is configured as a mandrel, although it is understood that other configurations of internal connector structures can be employed to prevent the collapse of the outer conductor 106 when the external connector structure 154 applies pressure to the outside of the outer conductor 106.

Once inserted, the internal connector structure 152 replaces the material from which the insulating layer 104 is formed in the cored-out section 112. This replacement changes the dielectric constant of the material positioned between the inner conductor 102 and the outer conductor 106 in the cored-out section 112. Since the impedance of the coaxial cable 100 is a function of the diameters of the inner and outer conductors 102 and 106 and the dielectric constant of the insulating layer 104, in isolation this change in the dielectric constant would alter the impedance of the cored-out section 112 of the coaxial cable 100. Where the internal connector structure 152 is formed from a material that has a significantly different dielectric constant from the dielectric constant of the insulating layer 104, this change in the dielectric constant would, in isolation, significantly alter the impedance of the cored-out section 112 of the coaxial cable 100.

However, the reduction of the diameter of the inner conductor 102 in the cored-out section 112 at the act 206 is configured to compensate for the difference in the dielectric constant between the removed insulating layer 104 and the inserted internal connector structure 152 in the cored-out section 112. Accordingly, the reduction of the diameter of the inner conductor 102 in the cored-out section 112 at the act 206 enables the impedance of the cored-out section 112 to remain about equal to the impedance of the remainder of the coaxial cable 100, thus avoiding internal reflections and resulting signal loss associated with inconsistent impedance.

In general, the impedance z of the coaxial cable 100 can be determined using Equation (1):

$$z = \left(\frac{138}{\sqrt{\varepsilon}}\right) * \log\left(\frac{\phi_{OUTER}}{\phi_{INNER}}\right) \tag{1}$$

where $\in$ is the dielectric constant of the material between the inner and outer conductors 102 and 106, $\phi_{OUTER}$ is the inside diameter of the outer conductor 106, and $\phi_{INNER}$ is the outside diameter of the inner conductor 102.

However, once the insulating layer 104 is removed from the cored-out section 112 of the coaxial cable 100 and the internal connector structure 152 is inserted into the cored-out section 112, the impedance z of the cored-out section 112 of the coaxial cable 100 can be determined using Equation (2):

$$z = \left(\frac{138}{\sqrt{\varepsilon_{EFF}}}\right) * \log\left(\frac{\phi_{OUTER}}{\phi_{INNER}}\right) \tag{2}$$

where $\in_{EFF}$ is the effective dielectric constant of the combination of an inner dielectric (the air around the inner conductor 102) and an outer dielectric (the internal connector structure 152) between the inner and outer conductors 102 and 106. The effective dielectric constant $\in_{EFF}$ can be determined using Equation (3):

$$\varepsilon_{EFF} = \frac{\varepsilon_{INNER} * \varepsilon_{OUTER} * \log\left(\frac{\phi_{OUTER}}{\phi_{INNER}}\right)}{\varepsilon_{INNER} * \log\left(\frac{\phi_{OUTER}}{\phi_{TRANS}}\right) + \varepsilon_{OUTER} * \log\left(\frac{\phi_{TRANS}}{\phi_{INNER}}\right)} \tag{3}$$

where $\phi_{TRANS}$ is the diameter of the transition between the inner dielectric and the outer dielectric, $\in_{INNER}$ is the dielectric constant of the inner dielectric, and $\in_{OUTER}$ is the dielectric constant of the outer dielectric.

In the example method 200 disclosed herein, the impedance z of the example coaxial cable 100 should be maintained at 50 Ohms Before termination, the impedance z of the coaxial cable is formed at 50 Ohms by forming the example coaxial cable 100 with the following characteristics:

$\in$=1.100;
$\phi_{OUTER}$=0.875 inches;
$\phi_{INNER}$=0.365; and
z=50 Ohms

During the method 200 for terminating the coaxial cable 100, the outside diameter of the inner conductor 102 $\phi_{INNER}$ is reduced from 0.365 inches to 0.361 inches at the act 206 in order to maintain the impedance z of the cored-out section 112 of the coaxial cable 100 at 50 Ohms, with the following characteristics:

$\in_{INNER}$=1.000;
$\in_{OUTER}$=2.800;
$\phi_{OUTER}$=0.875 inches;
$\phi_{INNER}$=0.361 inches;
$\phi_{TRANS}$=0.750 inches;
$\in_{EFF}$=1.126; and
z=50 Ohms This reduction of the diameter of the inner conductor 102 further enables the internal connector structure 152 to be formed from a material having a dielectric constant that does not closely match the dielectric constant of the material from which the insulating layer 104 is formed. This enables the internal connector structure 152 to be formed from a material that has superior strength and durability characteristics without regard to the dielectric constant of the material. In the example above, the dielectric constant of the material from which the insulating layer 104 is formed is 1.100, while the dielectric constant of the polycarbonate material from which the internal connector structure 152 is formed is 2.800. It is understood, however, that these dielectric constants are examples only, and the insulating layer 104 and the internal connector structure 152 can be formed from materials having other dielectric constants.

As disclosed in FIGS. 3D and 3E, the particular reduced diameter 114 of the inner conductor 102 correlates to the shape and type of material from which the internal connector structure 152 is formed. It is understood that any change to the shape and/or material of the internal connector structure 152 may require a corresponding change to the diameter of the inner conductor 102. Therefore, the example tool 300 of FIGS. 3A-3C may be used with a single type of internal connector structure, and each other type of internal connector structure may require a separate tool configured to reduce the diameter of the inner conductor by a specific amount.

With reference to FIGS. 2 and 3F, the method 200 is completed with the act 210 in which an external connector structure 154 of the connector 150 is affixed to the internal connector structure 152 of the connector 150. As disclosed in FIG. 3F, the external connector structure 154 compresses against the internal connector structure 152 through the outer conductor 106 of the coaxial cable 100. The internal connector structure 152 functions as a support structure to prevent the collapse of the outer conductor 106 when the external connector structure 154 applies pressure to the outside of the outer conductor 106. The act 210 thus terminates the coaxial cable 100 by permanently affixing the connector 150 to the terminal end of the coaxial cable 100, as disclosed in FIG. 1A.

The example embodiments disclosed herein may be embodied in other specific forms. The example embodiments disclosed herein are to be considered in all respects only as illustrative and not restrictive.

What is claimed is:

1. A terminated coaxial cable comprising:
an inner conductor configured to propagate a signal;
an insulating layer surrounding the inner conductor;
an outer conductor surrounding the insulating layer;
a jacket surrounding the outer conductor; and
a terminal section of the coaxial cable comprising:
a cored-out section of the coaxial cable in which the insulating layer has been removed and a diameter of the inner conductor has been reduced;
at least a portion of a connector mandrel positioned within the cored-out section and surrounding the reduced-diameter inner conductor; and
an external connector structure connected to the mandrel.

2. The terminated coaxial cable as recited in claim 1, wherein the insulating layer comprises a spiral-shaped spacer.

3. The terminated coaxial cable as recited in claim 1, wherein the insulating layer comprises a foamed material.

4. The terminated coaxial cable as recited in claim 1, wherein the mandrel and the external connector structure are portions of a compression-type connector.

5. The terminated coaxial cable as recited in claim 1, wherein the inner conductor comprises a hollow inner conductor.

6. The terminated coaxial cable as recited in claim 1, wherein the impedance of the terminal section of the coaxial cable is about equal to the impedance of the remainder of the coaxial cable.

7. A coaxial cable termination tool configured for use in the termination of a coaxial cable, the coaxial cable comprising an inner conductor, an insulating layer surrounding the inner conductor, an outer conductor surrounding the insulating layer, and a jacket surrounding the outer conductor, the coaxial cable termination tool comprising:
a body comprising:
means for coring out a section of the insulating layer; and
means for reducing the diameter of the inner conductor that is positioned within the cored-out section.

8. The tool as recited in claim 7, wherein the means for coring out a section of the insulating layer comprises a rotary cutting blade configured to automatically cut out a length of the insulating layer about equal to the length of a portion of a particular internal connector.

9. The tool as recited in claim 7, wherein the means for reducing the diameter of the inner conductor comprises a rotary swaging die configured to rotationally swage a length of the center conductor about equal to the length of a portion of a particular internal connector.

10. The tool as recited in claim 7, wherein the means for reducing the diameter of the inner conductor comprises a structure configured to automatically remove a portion of the material from which the inner conductor is formed.

11. The tool as recited in claim 7, further comprising a drive shank extending outward from a back end of the body, the drive shank being configured to be received in a drill chuck.

12. The tool as recited in claim 11, further comprising a guide pin extending outward from a front end of the body, the pin being configured to be inserted into a hollow portion of the inner conductor.

13. The tool as recited in claim 12, wherein the means for reducing the diameter of the inner conductor is further configured to reduce the diameter of the hollow portion of the inner conductor to be about equal to a diameter of the pin.

14. A method for terminating a coaxial cable, the coaxial cable comprising an inner conductor, an insulating layer surrounding the inner conductor, an outer conductor surrounding the insulating layer, and a jacket surrounding the outer conductor, the method comprising the following acts:
coring out a section of the insulating layer;
reducing a diameter of the inner conductor that is positioned within the cored-out section;
inserting at least a portion of an internal connector structure into the cored-out section so as to surround the reduced-diameter inner conductor; and
affixing an external connector structure to the internal connector structure.

15. The method as recited in claim 14, wherein the act of reducing the diameter of the inner conductor comprises swaging the inner conductor.

16. The method as recited in claim 14, wherein the act of reducing the diameter of the inner conductor comprises removing a portion of the material from which the inner conductor is formed.

17. The method as recited in claim 14, wherein the diameter of the inner conductor is reduced to the extent that the impedance of the cored-out section with the inserted internal connector structure about matches the impedance of the remainder of the coaxial cable.

18. The method as recited in claim 14, wherein the act of coring out a section of the insulating layer is accomplished using a coaxial cable termination tool configured to core out a length of the insulating layer about equal to the length of the portion of the internal connector structure that is inserted into the cored-out section.

19. The method as recited in claim 18, wherein the act of reducing the diameter of the inner conductor is accomplished using the coaxial cable termination tool further configured to reduce the diameter of a length of the inner conductor about equal to the length of the portion of the internal connector structure that is inserted into the cored-out section.

20. The method as recited in claim 19, wherein the acts of coring out a section of the insulating layer and reducing the diameter of the inner conductor are performed simultaneously using the coaxial cable termination tool.

* * * * *